United States Patent [19]

Heinzel

[11] Patent Number: 4,779,925

[45] Date of Patent: Oct. 25, 1988

[54] HEIGHT-ADJUSTABLE SWIVEL CHAIR EQUIPPED WITH GAS-PRESSURE SPRING, ESPECIALLY OFFICE CHAIR OR OFFICE ARMCHAIR

[76] Inventor: Eberhard Heinzel, Eichenweg 5 D-5789, Hallenberg, Fed. Rep. of Germany

[21] Appl. No.: 45,878

[22] Filed: Apr. 22, 1987

[30] Foreign Application Priority Data

May 15, 1986 [DE] Fed. Rep. of Germany ..... 3616475

[51] Int. Cl.[4] ..... A47C 3/18

[52] U.S. Cl. ..... 297/301; 297/345; 297/349; 297/355

[58] Field of Search ..... 297/306, 304, 303, 302, 297/301, 345, 349, 355, 347

[56] References Cited

U.S. PATENT DOCUMENTS

| | | | |
|---|---|---|---|
| 4,560,199 | 12/1985 | Sapper | 297/301 |
| 4,603,905 | 8/1986 | Stucki | 297/306 X |
| 4,662,680 | 5/1987 | Dauphin | 297/300 |
| 4,682,814 | 7/1987 | Hansen | 297/300 |

FOREIGN PATENT DOCUMENTS

| | | |
|---|---|---|
| 1270244 | 6/1968 | Fed. Rep. of Germany . |
| 3303265 | 8/1984 | Fed. Rep. of Germany . |
| 8417429 | 9/1984 | Fed. Rep. of Germany . |
| 3616475 | 6/1987 | Fed. Rep. of Germany . |

*Primary Examiner*—James T. McCall
*Attorney, Agent, or Firm*—Young & Thompson

[57] ABSTRACT

In the swivel chair, a seat frame and a backrest frame are joined by articulation and movable with a rocking motion synchronously against spring force, and the tilt of seat and backrest can be locked in several positions. The entire mechanical system for the tripping, adjustment, and locking of the tilt of seat frame and backrest frame, for triggering the height adjustment, and for setting the rocking spring force is accommodated in a supporting tube that is bent at an obtuse angle. This supporting tube surrounds in a rotatable and displaceable fashion a base tube at the lower end, this base tube being seated on a compound base and accommodating the gas-pressure spring, and is connected at the upper end with a horizontal transverse tube extending perpendicularly to the supporting tube, this transverse tube housing the swivel axles of the seat frame as well as of the backrest frame. The pivot axle of the backrest frame is constituted by two torsion springs which are respectively fixed with a longer, angled spring leg within a tube of the bottom part of the backrest frame and are in contact, with a shorter spring leg, against an adjustably designed abutment in the upper end of the supporting tube.

17 Claims, 8 Drawing Sheets

Figure 3:
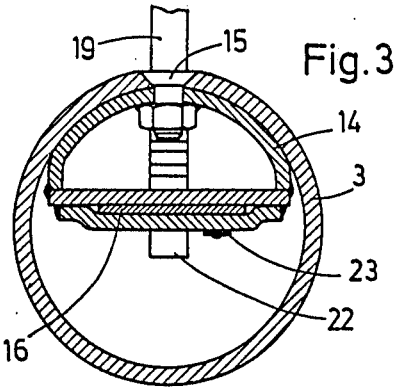

HEIGHT-ADJUSTABLE SWIVEL CHAIR EQUIPPED WITH GAS-PRESSURE SPRING, ESPECIALLY OFFICE CHAIR OR OFFICE ARMCHAIR

The invention relates to a swivel chair of the type set forth in the preamble of claim 1.

In such chairs or armchairs wherein seat and back are separately pivotably supported for the execution of rocking motions, the so-called "undressing effect" occurs as a rule, i.e. during rocking or during tilt adjustment a change results in the distance between the seating center and the backrest center; as a consequence, the clothing of the person occupying the chair or armchair is displaced in the back region, for example the shirt is pulled out of the trousers.

German Utility Model No. 84 17 429 discloses, for example, a "center-synchronized adjusting device" which is to avoid this disadvantageous effect. However, for this purpose, an expensive and, above all, voluminous mechanism is arranged underneath the seat which, in addition, does not exactly render the design of the chair or armchair esthetic.

The invention is based on the object of overcoming the above-discussed problem of the "undressing effect" by means of a relatively simple and compactly accommodated rocking and tilting adjustment mechanism.

This object has been attained according to this invention by characterizing features (a) and (b) of claim 1. Advantageous further embodiments of the invention can be derived from the dependent claims as well as from the subsequent description of embodiments illustrated in the drawings.

The swivel chair of this invention affords, due to the far forwardly displaced rocking axes of the seat and the backrest, an optimum synchronous movement to avoid the "undressing effect" with a space-saving accommodation of the total mechanism, making it possible to provide an entirely novel and additionally rugged chair design, wherein no bellows is required to cover any pinch or shear zones. The supporting structure, consisting exclusively of economical steel tubing, serves as a basic frame for an entire family of models, i.e. from a steno chair up to the heavy executive armchair.

Figure 1:
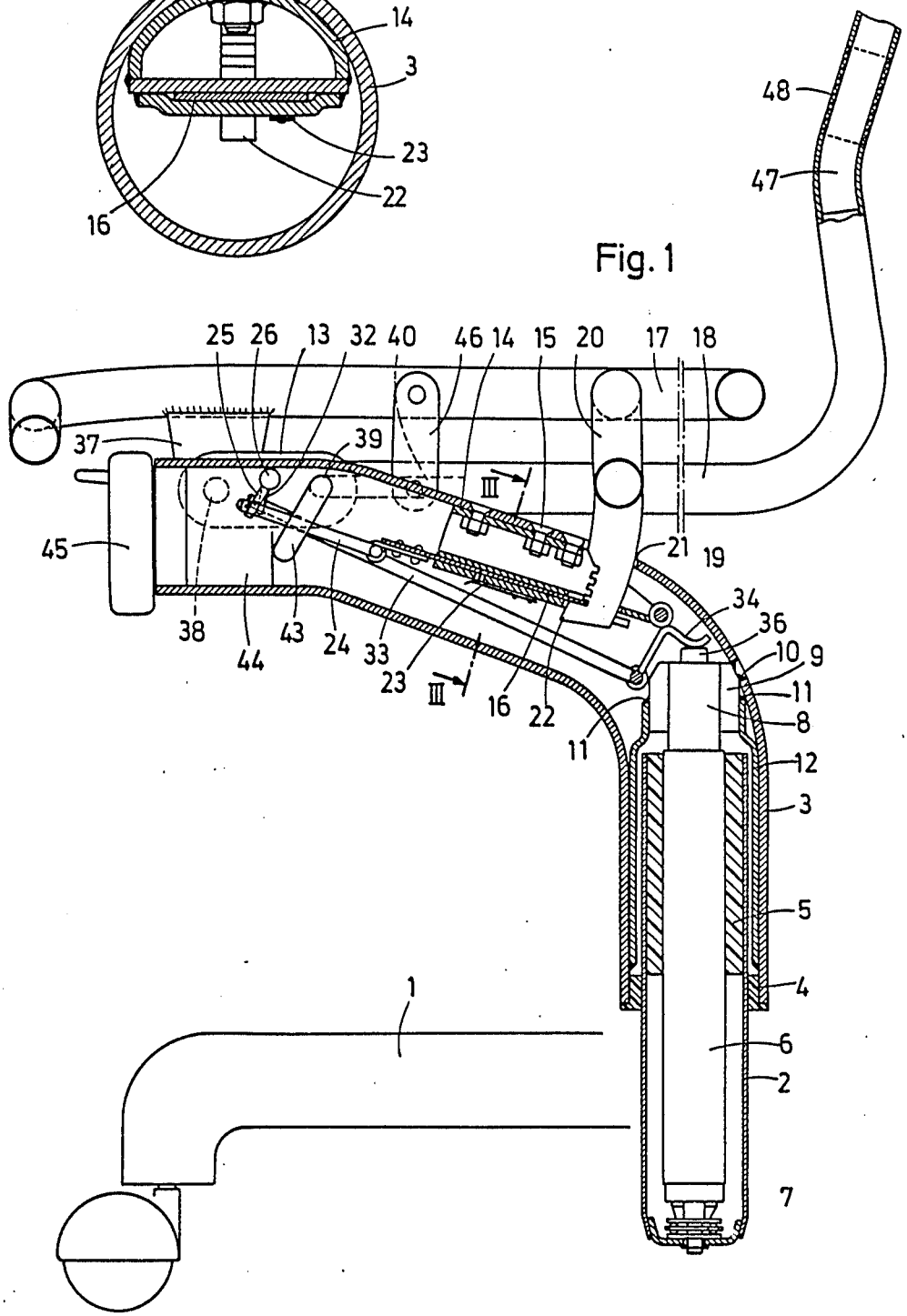
Figure 2:
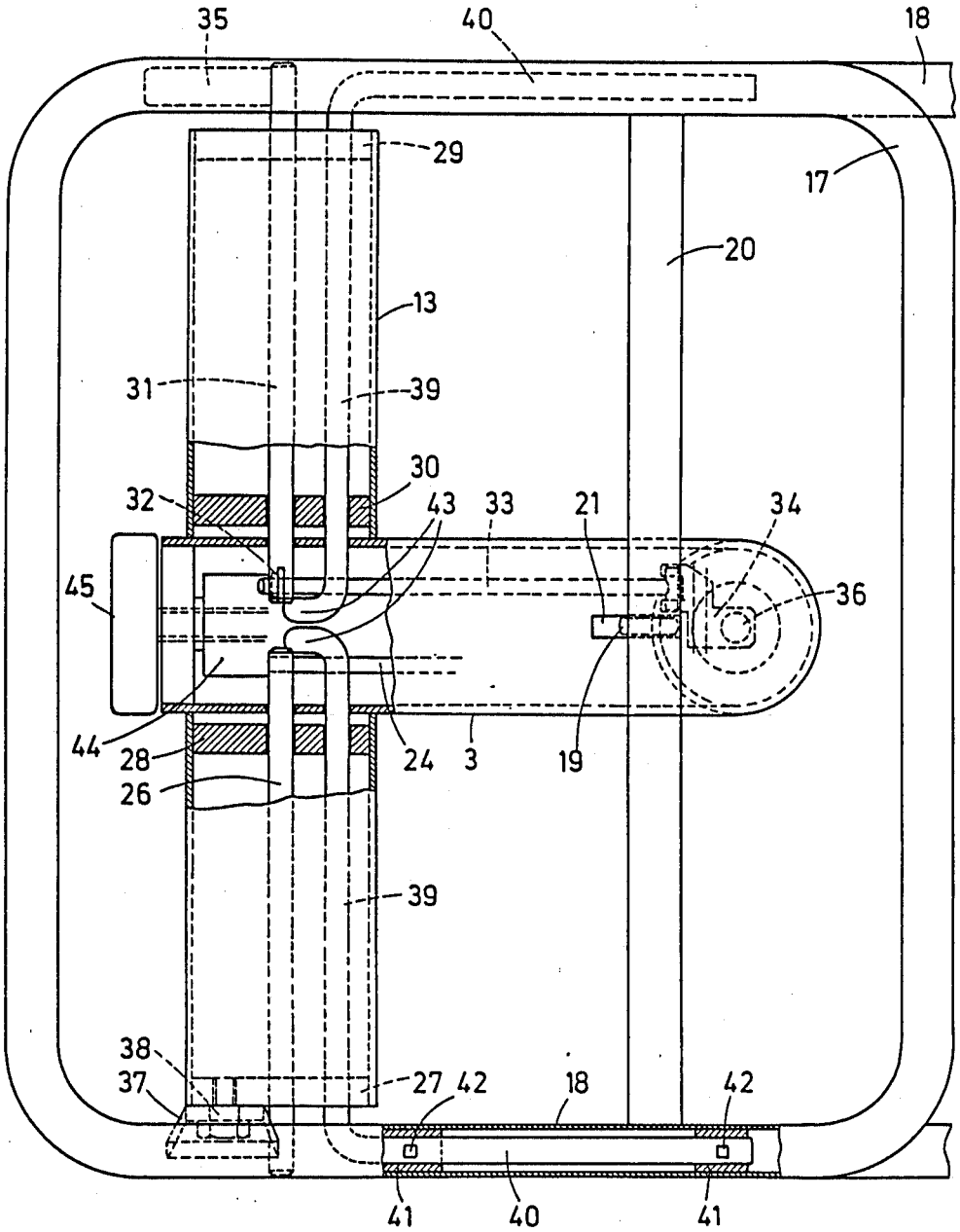
Figure 4:
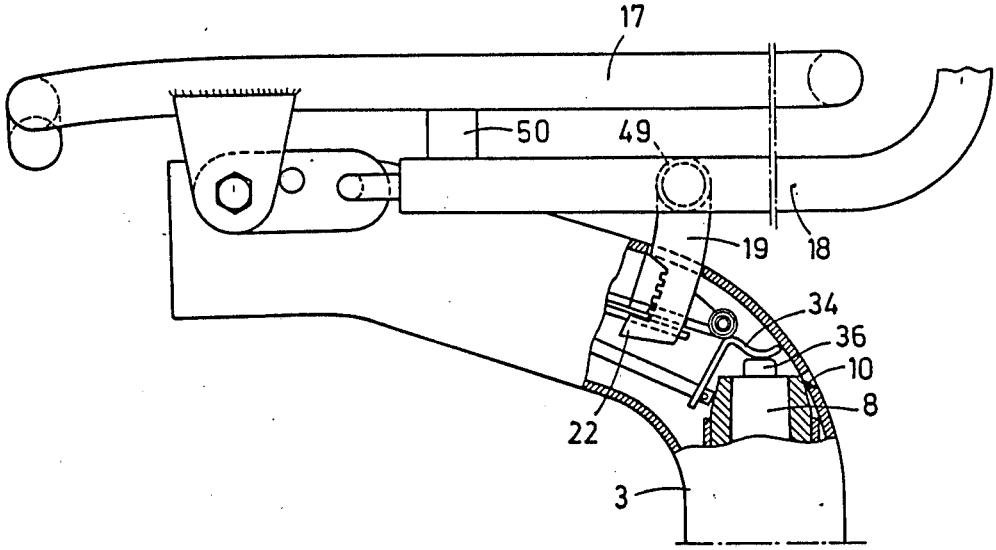
Figure 5:
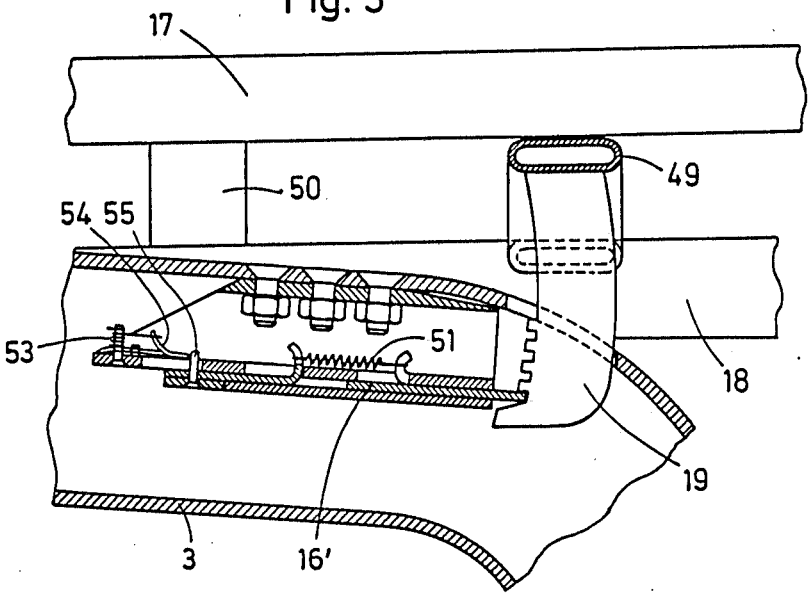
Figure 6:
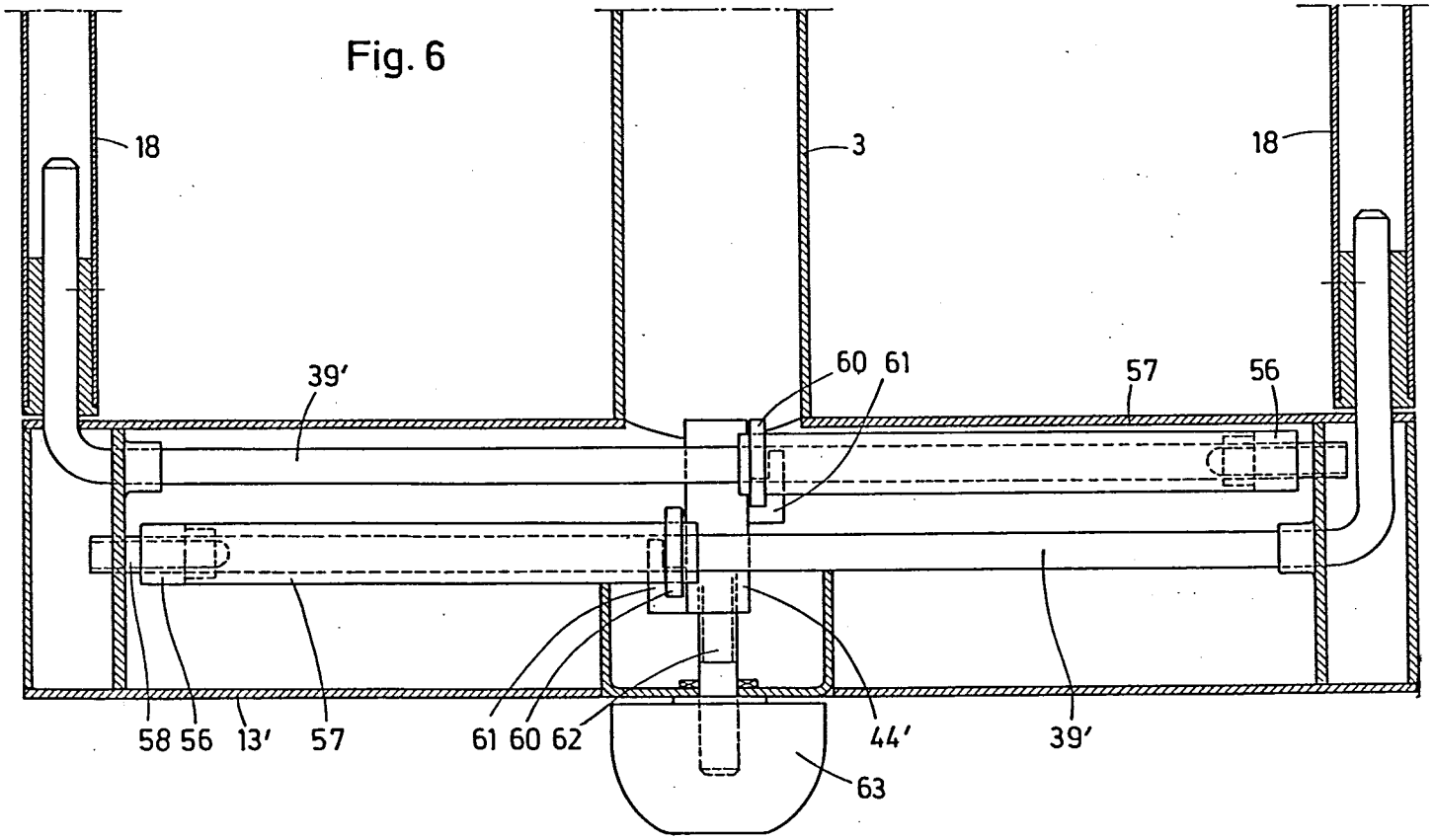
Figure 7:
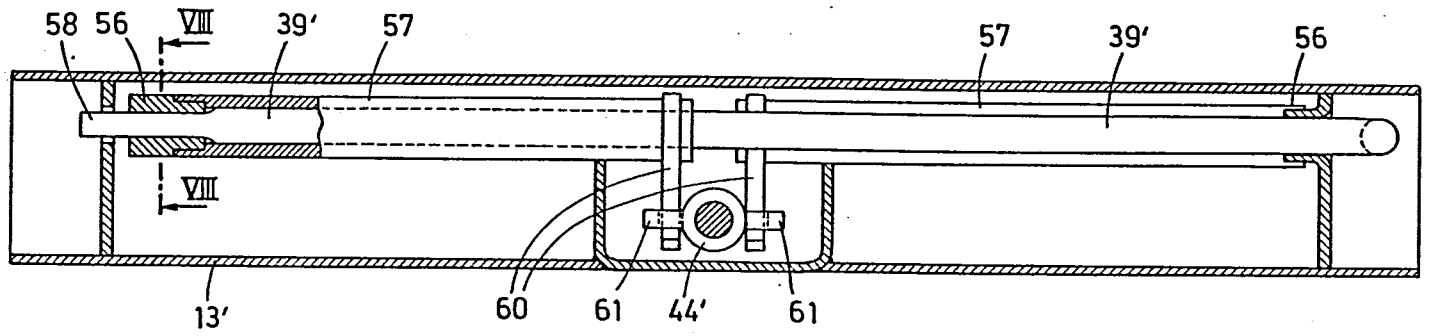
Figure 8:
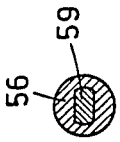
Figure 9:
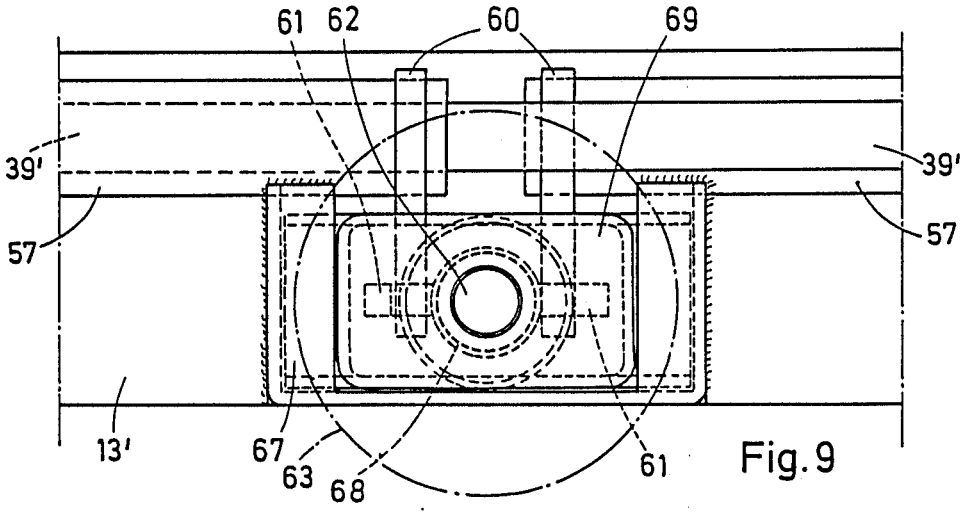
Figure 10:
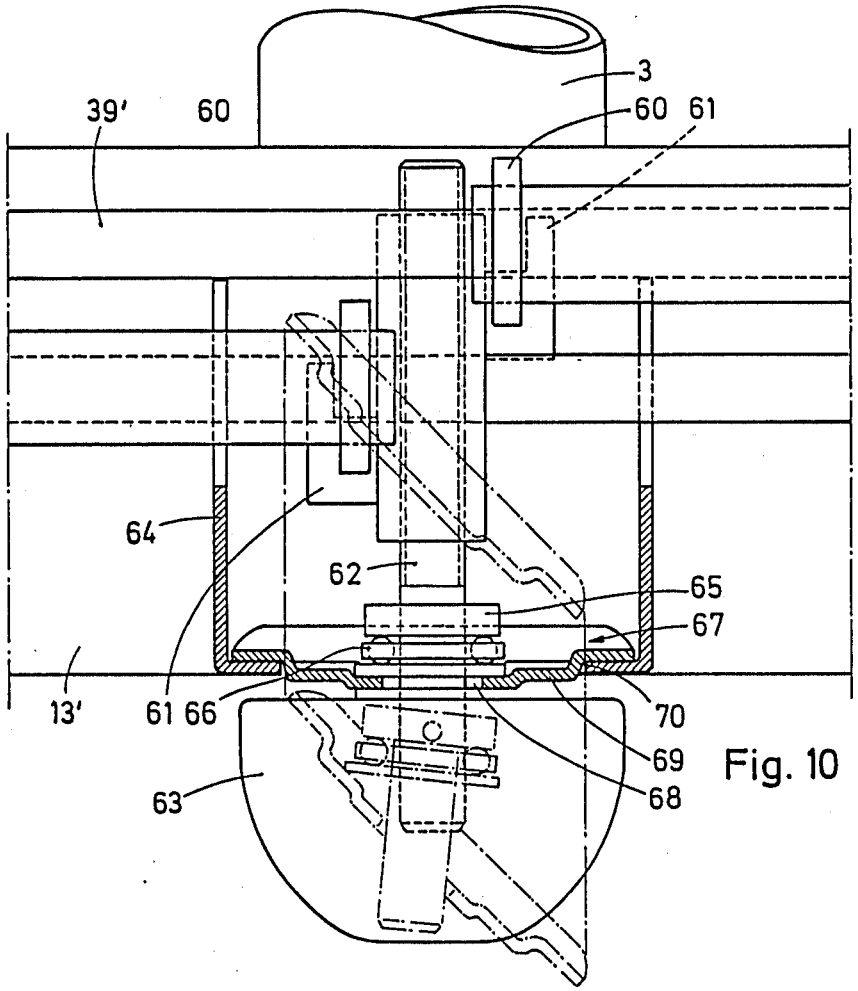
Figure 11:
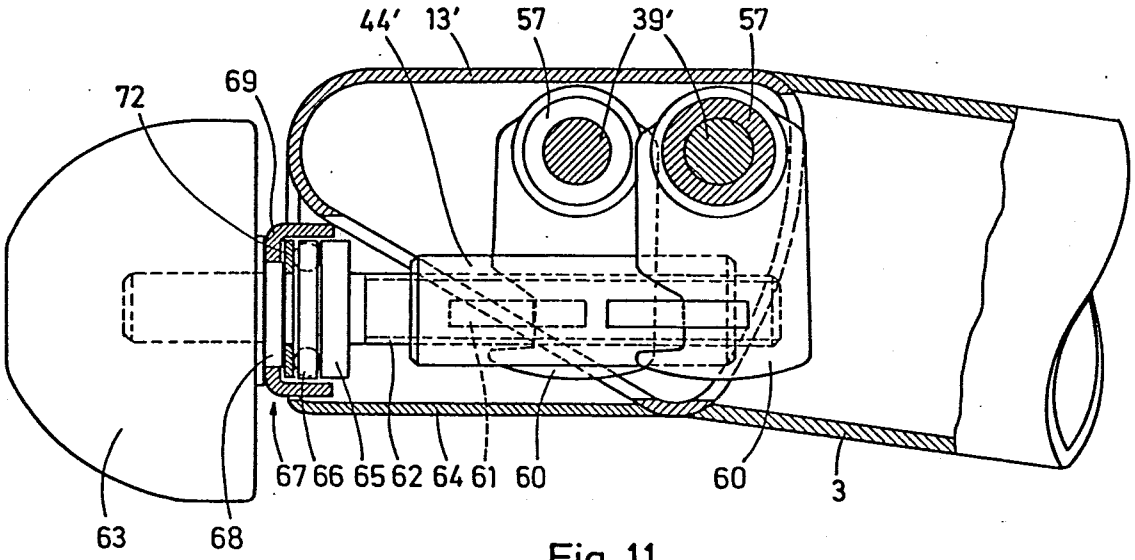
Figure 12:
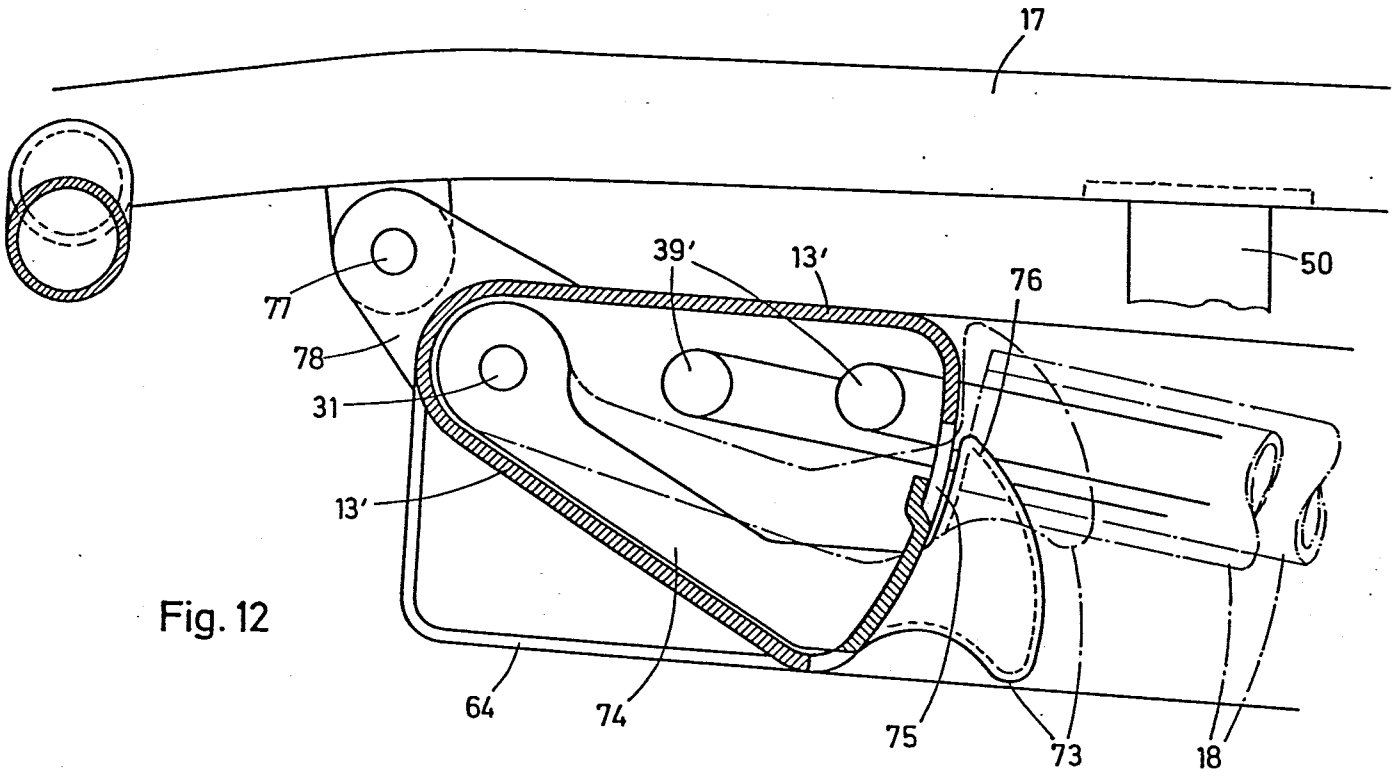

In the drawings:

FIG. 1 shows a vertical section through the swivel chair of a first embodiment, FIG. 2 shows a top view, partially broken up or broken away, of the swivel chair according to FIG. 1, FIG. 3 shows a section along line III—III in FIG. 1, FIG. 4 shows a second embodiment in a partially sectional, lateral view, FIG. 5 shows a section through a portion of the supporting tube with the detent mechanism, FIG. 6 shows a top view of a third embodiment FIG. 7 shows a front view of this embodiment, FIG. 8 shows a partial section along line VIII—VIII in FIG. 7, FIG. 9 shows, in a frontal view, the mechanism for adjusting the pretensioning of the torsion springs, FIG. 10 shows a top view of the arrangement according to FIG. 9, FIG. 11 shows a sectional lateral view of this arrangement, and FIG. 12 shows, in a lateral view, the disposition and structure of an operating key.

The lower end of a supporting tube (3), bent at an obtuse angle, is guided displaceably and rotatably on a base tube (2) fixedly connected to a multi-strut base (1) of the swivel chair; between the base tube (2) and the supporting tube (3), a synthetic resin bushing (4) is provided for guidance and additional support. The base tube (2) accommodates, in its interior in a guide bushing (5) of a synthetic resin, a gas-pressure spring (6) resting at the bottom in the base tube (2) on an axial thrust bearing (7) and being mounted at the top with a cone (8) in a conical bushing (9) which latter is welded at (10) via a bore to the supporting tube (3) and at (11) to an insert tube (12) welded into the lower end of the supporting tube (3). A transverse tube (13) is fixedly connected with the upper end of the supporting tube (3). In this arrangement, the supporting tube (3) and the transverse tube (13) are cut out and welded together in such a way that the inside cross section of both tubes (3, 13) is not constricted by this connection at any location. The transverse tube (13) extends perpendicularly to the supporting tube (3) and lies horizontally.

As shown in FIG. 1, the entire mechanism for chair adjustment is accommodated in the upper end of the supporting tube (3). In this arrangement, a guide block (14) is mounted by means of screws (15) in the supporting tube (3). A detent (16) is displaceably arranged in the guide block (14) and engages, for determining a tilt position of a seat frame (17) and of a backrest frame (18), into a toothed rack (19) which latter, in the embodiment of FIGS. 1 and 2, is attached to a cross strap (20) of the seat frame (17) and projects by way of an opening (21) into the supporting tube (3). The toothed rack (19) exhibits a longer tooth (22) at the free inner end, this tooth abutting the detent (16) when the latter is retracted so that the toothed rack (19) cannot be pulled entirely out of the opening (21) of the supporting tube (3). For this purpose, the tripping movement of the detent (16) is restricted by a leaf spring (23) which can be forced out of the way during the disassembly of the mechanism by means of a screw driver or the like.

The detent (16) is connected via a connecting rod (24) to a lever (25) at a shaft (26), this shaft being supported in small bearing blocks (27, 28) within the left-hand side of the cross tube (13) and carrying on the outer end an operating lever (not illustrated herein), this lever being accessible at the front on the left-hand side beneath the seat frame (17). Additional small bearing blocks (29, 30) are provided in the right-hand side of the transverse tube (13), an additional shaft (31) in alignment with the shaft (26) being supported therein; this shaft (31) pertains to the operating mechanism for the height adjustment of the chair. A lever (32) on the inner end of the shaft (31) is connected, via a connecting rod (33), with an angle lever (34) supported at the rear end of the guide block (14). This angle lever, upon actuation of an operating lever (35) (FIG. 2) accessible from the right-hand side at the front underneath the seat, exerts pressure on a plunger (36) of the valve of the gas-pressure spring (6) in order to release the spring for height adjustment.

The seat frame (17) exhibits bearing lugs (37) on both sides at the front end; pivots (38) that can be threaded into the outer small bearing blocks (27, 29) serve for the rotatable support of these lugs. The axle for the pivotal support of the backrest frame (18) in the small bearing blocks (27–30) is constituted by two torsion springs (39) fixed in place with respectively one long spring leg (40) in an associated tube of the lower portion of the backrest frame (18). For this purpose, these tubes include bushings (41) (see FIG. 2), and the spring legs (40) have bevels (42) engaged by clamping screws (not shown).

In the region of the connecting point between the supporting tube (3) and the transverse tube (13), the torsion springs (39) have shorter spring legs (43) pressing against a stop block (44) fashioned as an adjusting nut; this block is adjustable at the front end of the supporting tube (3) by means of a knurled disk (45) in order to set the spring force of the torsion springs (39). The seat frame (17) and the backrest frame (18) are joined on both sides by means of joint fishplates (46).

Additional spring elements (47) are inserted in both lateral tubes of the upper part of the backrest frame (18); flexible synthetic resin sheaths (48) are threaded onto the free lengths of these spring elements, supplementing the diameter of the tubes of the backrest frame (18).

The embodiment illustrated in FIG. 4 differs from the embodiment of FIG. 1 merely in that the toothed rack (19) is in this arrangement attached to a cross strap (49) of the lower part of the backrest frame (18), and the latter is joined to the seat frame (17) by way of rubber-metal buffers (50).

The torsion springs (39) are preferably made of steel rods, but they can also consist of leaf-spring packs. The padding of the chair, not shown, can be of any desired type since the disclosed chair frame and its mechanical components serve, as mentioned in the foregoing, as a basic framework for an entire family of models.

FIG. 5 shows, in a partially sectional view, a further embodiment of the swivel chair. The detent (16') is under the force of a spring (51) which has the tendency to insert the detent (16') in the toothed rack (19). A key (not shown herein) for triggering the detent (16') is fashioned as an indexing key, i.e. during the first depression of the key, the detent (16') is pulled out of the toothed rack (19) and then is again released upon the second depressing of the key. For this purpose, a locking device is utilized with a pawl (54) pivotable in two planes under the action of a spring (53), as is customary in click-stop switching keys of electrical or electronic appliances and thus needs no detailed explanation. The pawl (54) cooperates with a pin (55) at the detent (16').

In the embodiment of FIGS. 6 and 7, larger effective spring lengths are available for the torsion springs (39'). For this purpose, the extreme ends of the torsion springs (39') are mounted in shape-mating connection with tubes (57) by way of coupling bushings (56) (see FIGS. 7 and 8); these tubes transmit the torsion force in the direction toward a spindle nut (44'). Beveled ends (58) of the torsion springs (39') are isnerted in corresponding shallow bores (59) of the coupling bushings (56). Hooks (60) are attached to the inner ends of the tubes (57), these hooks engaging into hook-shaped extensions (61) at the spindle nut (44'). By adjustment of an adjusting spindle (62) seated in the spindle nut (44') by means of a rotary knob (63), the pretensioning of the torsion springs (39') can be set.

FIGS. 9–11 show, on a somewhat enlarged scale, the adjusting mechanism for the pretensioning of the torsion springs (39'). A forwardly projecting, rectangular, housing-type extension (64) is attached to the transverse tube (13') and accommodates the adjusting spindle (62) and the spindle nut (44'). The adjusting spindle (62) exhibits an annular collar (65) in contact with an axial ball bearing (66) which latter abuts, at the other end, against an essentially rectangular counterpressure disk (67); the latter, as indicated in dot-dash lines in FIG. 10, makes it possible to install the spindle (62) with nut (44') and to effect its own installation without screws and any tool, since the counterpressure disk (67) exhibits a widened bore (68). In the assembled condition, the counerpressure disk (67) is seated with a flat indentation (69) in a recess (70) of the housing-like extension (64). In a round crimp (71) of the indentation (69), a race (72) for the ball bearing (66) is disposed, this race having a bore adapted to the spindle (62) and thus fixing the adjusting spindle (62) in place concentrically to the flaring bore (68) of the counterpressure disk (67), namely under the constant pressure of the torsion springs (39').

FIG. 12 shows, inter alia, the arrangement and structure of an operating key (73) which is supported on one end (here on the right-hand end) of the transverse tube (13'), is connected via a lever (74) to the shaft (31) already mentioned in the description of FIG. 2, and pertains to the operating mechanism for the height adjustment of the swivel chair. The lever (74) projects out of the transverse tube (13') through a slot (75), and the operating key (73) exhibits toward the top a beak-like extension (76) covering the slot (75) in the rest position of the lever (74) and preventing pinch injuries to fingers.

According to FIG. 12, the seat frame (17) is furthermore tiltable about an axle (77) within limits once this tilting movement has been released by the detent (16). The seat frame (17) is, for this purpose, supported on cantilevers (78) in front of the forward, top rim of the transverse tube (13').

I claim:

1. Height-adjustable swivel chair equipped a gas-pressure spring, especially office chair or office armchair, wherein a seat frame and a backrest frame are joined with articulation and being movable with a rocking motion synchronously against spring force, and the tilt of seat and backrest can be locked in several positions, characterized by the following features:

(a) the entire mechanism for the releasing, adjusting, and locking in place of the tilt of the seat frame (17) and the backrest frame (18), for tripping the height adjustment, and for adjusting the rocking spring force is accommodated in a supporting tube (3) bent at an obtuse angle, this supporting tube surrounding at the bottom end in a rotatable and displaceable fashion a base tube (2) mounted on a compound base (1) and accommodating the gas-pressure spring (6), and being connected at the upper end with a horizontal transverse tube (13) extending transversely to this supporting tube, this transverse tube housing the swivel axles of the seat frame (17) as well as of the backrest frame (18);

(b) the swivel axle of the backrest frame (18) is constituted by two torsion springs (39), each of which is fixed in place, with a longer, angled spring leg (40), in a tube of the bottom portion of the backrest frame (18) and is in contact, with a shorter spring leg (43), with an adjustably designed stop block (44) in the upper end of the supporting tube (3).

2. A swivel chair according to claim 1, characterized in that the seat frame (17) and the bottom part of the backrest frame (18) are connected to each other on both sides of the chair by way of joint fishplates (46), and that, for tilt adjustment, a toothed rack (19) is attached to a cross strap (20) of the seat frame (17), projects by way of an opening (21) into the supporting tube (3), and cooperates within the latter with a detent (16) displaceably supported in a guide block (14).

3. A swivel chair according to claim 1, characterized in that the toothed rack (19) is attached to a cross strap (49) of the bottom part of the backrest frame (18), and the seat frame (17) and the bottom part of the backrest frame (18) are connected to each other by way of rubber-metal buffers (50).

4. A swivel chair according to claim 1 characterized in that small bearing blocks (27–30) are provided in the arms of the horizontal transverse tube (13) extending toward both sides away from the supporting tube (3), for the torsion springs (39) and for shafts (26, 31), there being attached to the outer ends of these shafts respectively one operating lever accessible underneath the seat, for the detent (16) of the rocking mechanism on one side and for an angle lever (34), supported at the rear end of the guide block (14), for operating the valve plunger (36) of the gas-pressure spring (6) on the other side.

5. A swivel chair according to claim 4, characterized in that the angle lever (34) for operating the valve plunger (36), and the detent (16), are respectively articulated by way of connecting rods (24, 33) to levers (25, 32) attached to the shafts (26, 31).

6. A swivel chair according to claim 2, characterized in that a leaf spring (23) is provided at the guide block (14) for limiting the tripping movement of the detent (16).

7. A swivel chair according to claim 4, characterized in that bearing lugs (37) projecting downwardly and attached to the front end of the seat frame (17) are rotatably supported at the respectively outer small bearing blocks (27, 29) on pivots (38).

8. A swivel chair according to claim 1, characterized in that the torsion springs (39) consist of steel rod material.

9. A swivel chair according to claim 1, characterized in that the torsion springs (39) consist of leaf spring packs.

10. A swivel chair according to claim 1, characterized in that a synthetic resin bushing (4) for the guidance and additional support of the supporting tube (3) is provided in the lower end of the supporting tube (3) surrounding the base tube (2).

11. A swivel chair according to claim 1, characterized in that additional spring elements (47) are inserted in lateral tubes of the upper part of the backrest frame (18).

12. A swivel chair according to claim 11, characterized in that the spring elements (47) are steel rods, on the uncovered sections of which flexible synthetic resin sheaths (48) are threaded, the outer diameter of these sheaths being equal to that of the tubes of the backrest frame (18).

13. A swivel chair according to claim 1, characterized in that the supporting tube (3) and the horizontal transverse tube (13) extending transversely thereto are inserted one in the other and are welded together in such a way that the inside cross section of both tubes (3, 13) is vacant.

14. A swivel chair according to claim 13, characterized in that the transverse tube (13) has a rounded, triangular cross section, the height of which corresponds essentially to the diameter of the supporting tube (3).

15. A swivel chair according to claim 1, characterized in that the stop block (44) is fashioned as a spindle nut (44') which is engaged by an adjusting spindle (62).

16. A swivel chair according to claim 1, characterized in that the pivot axle of the seat frame (17) is placed on the transverse tube (13), and that, for operating the seat tilt and the height adjustment, operating keys are integrated into the transverse tube (13), of which keys the operating key (52) for the rocking mechanism is designed as an indexing key.

17. Swivel chair according to claim 1, characterized in that the outer ends of the torsion springs (39') are connected, within the transverse tube (13'), in a shape-mating fashion with the one ends of tubes (57) loosely surrounding these springs, these tubes, with their other ends, engaging by means of hooks (60) into hook-shaped extension (61) of the spindle nut (44').

* * * * *